US008485244B2

(12) United States Patent
Fukuda et al.

(10) Patent No.: US 8,485,244 B2
(45) Date of Patent: Jul. 16, 2013

(54) CONTINUOUS CASTING DEVICE AND MOLTEN METAL POURING NOZZLE

(75) Inventors: Masashi Fukuda, Kitakata (JP); Masatoshi Fukushima, Kitakata (JP)

(73) Assignee: Show Denko K.K., Tokyo (JP)

( * ) Notice: Subject to any disclaimer, the term of this patent is extended or adjusted under 35 U.S.C. 154(b) by 0 days.

(21) Appl. No.: 12/745,919

(22) PCT Filed: Dec. 4, 2008

(86) PCT No.: PCT/JP2008/072050

§ 371 (c)(1),
(2), (4) Date: Sep. 10, 2010

(87) PCT Pub. No.: WO2009/072558

PCT Pub. Date: Jun. 11, 2009

(65) Prior Publication Data

US 2011/0209846 A1 Sep. 1, 2011

(30) Foreign Application Priority Data

Dec. 5, 2007 (JP) ..... 2007-314504

(51) Int. Cl.
*B22D 11/00* (2006.01)
*B22D 11/10* (2006.01)

(52) U.S. Cl.
USPC ..... 164/437; 164/440

(58) Field of Classification Search
USPC ..... 164/437, 440, 472, 418, 490
See application file for complete search history.

(56) References Cited

U.S. PATENT DOCUMENTS

| | | | | |
|---|---|---|---|---|
| 4,640,336 | A * | 2/1987 | Arakawa et al. | 164/440 |
| 2005/0126745 | A1 * | 6/2005 | Bowles et al. | 164/490 |
| 2006/0090875 | A1 | 5/2006 | Fukuda et al. | |

FOREIGN PATENT DOCUMENTS

| | | | |
|---|---|---|---|
| CN | 1671495 | A | 9/2005 |
| DE | 25 20 091 | A1 | 11/1976 |
| EP | 0 153 014 | A1 | 8/1985 |
| JP | 56-084157 | A | 7/1981 |
| JP | 62-46164 | U | 3/1987 |
| JP | 11-170009 | A | 6/1999 |
| JP | 2006-150447 | A | 6/2006 |

OTHER PUBLICATIONS

Official Communication issued in International Patent Application No. PCT/JP2008/072050, mailed on Mar. 3, 2009.
Official Communication issued in corresponding European Patent Application No. 08857133.6, mailed on Feb. 20, 2012.

* cited by examiner

*Primary Examiner* — Kevin P Kerns
*Assistant Examiner* — Steven Ha
(74) *Attorney, Agent, or Firm* — Keating & Bennett, LLP

(57) ABSTRACT

A continuous casting device capable of giving lubricating property to a molten metal pouring nozzle without increasing lubricating oil and performing casting with high casting surface quality for a long period of time is provided. In a continuous casting device 1 in which a molten metal pouring nozzle 20 is arranged between a molten metal receiving portion 10 and a mold 40, the molten metal pouring nozzle 20 is equipped with a cylindrical main body portion 22 made of a fire-resistant substance and having a molten metal passage 21, and an annular member 30 having self-lubricating property is arranged on a mold-side end face 23 of the main body portion 22 so as to surround the molten metal passage 21.

8 Claims, 7 Drawing Sheets

CONTINUOUS CASTING DEVICE AND MOLTEN METAL POURING NOZZLE

TECHNICAL FIELD

The present invention relates to a continuous casting device equipped with a molten metal pouring nozzle having a molten metal passage arranged between a molten metal receiving portion and a mold and configured to manufacture a metal cast bar by supplying molten metal in a molten metal receiving portion to the mold through the molten metal passage.

BACKGROUND ART

FIG. 7 shows a structure of a conventional horizontal continuous casting device 2.

In the aforementioned horizontal continuous casting device 2, a bar-shaped lengthy ingot is manufactured from molten metal via the following steps. That is, the molten metal M in the molten metal receiving portion 10 passes through a molten metal passage 21 of a molten metal pouring nozzle 50 made of a fire-resistant substance via a molten metal outlet port 11. Thereafter, the molten metal M is introduced into a cylindrical mold 40 arranged approximately horizontally, and forcibly cooled to thereby form a solidified shell on a surface of the molten metal. Furthermore, a cooling water C is directly sprayed onto the ingot S pulled out of the mold 40. Thus, an ingot S is continuously extruded while being solidified up to an inside of the ingot. In such a horizontal continuous casting device 2, lubricating oil is supplied from an inner peripheral wall of the mold 40 through a supplying pipe 43 opened at the inlet side of the mold 40 to prevent burning of the ingot S to the wall of the mold 40 (see Patent Document 1).

In the aforementioned horizontal continuous casting device 2, in the case of an alloy which easily causes burning, for example, an aluminum alloy containing 0.5 mass % or more of Mg, it is necessary to prevent occurring of burning by increasing the amount of lubricating oil to be supplied from the supplying pipe 43.

[Patent Document 1]

Japanese Unexamined Laid-open Patent Application Publication No. H11-170009

SUMMARY OF THE INVENTION

Problems to be Solved by the Invention

However, supplying a large amount of lubricating oil causes problems. That is, excessively vaporized gaseous lubricating oil causes breakout of an ingot. The excessive lubricating oil contacts the molten metal, causing reaction products (carbide), and the reaction products are caught in an ingot, increasing the cutting portion of the ingot surface, or resulting in a defective product.

Means for Solving the Problems

In view of the aforementioned technical background, as a result of a keen study for solving the problems of a conventional horizontal continuous casting, the present invention was made by focusing attention on the following points.

In the aforementioned horizontal continuous casting device 2, the molten metal M passed through the molten metal pouring nozzle 50 flows into the molding hole 41 of the mold 40 while contacting the end face of the molten metal pouring nozzle 50. In this step, the molten metal M is slightly cooled by the end face of the molten metal pouring nozzle 50, and gas accumulation G is formed between the mold 40 and the molten metal M. The inventors found the fact that a thin solidified shell is formed at the molten alloy surface contacting the gas accumulation G at the outside area of the end face of the molten metal pouring nozzle 50, or the vicinity of the periphery of the molding hole 41 of the mold 40. The inventors thought that a fire-resistant substance forming the molten metal pouring nozzle 50 is generally poor in self-lubrication and lacks lubrication to facilitate advance movement of the molten alloy with a thin solidified shell. The inventors found the fact that lack of lubrication at the end face of the molten metal pouring nozzle 50 causes deterioration of the casting surface quality due to adhesion of molten alloy which begins to be solidified, or breakout.

Furthermore, the inventors found the fact that the lubricating oil is pushed up by the difference of gravity applied to the upper surface and lower surface of the ingot S and the vaporized lubricating oil is also raised, which tends to cause lack of lubricating oil especially at the bottom of the ingot S.

The present invention aims to provide a continuous casting device and a molten metal pouring nozzle capable of continuously casting an ingot excellent in casting surface quality by applying a lubricating property to the molten metal pouring nozzle end face without increasing an amount of lubricating oil for luck of lubricating oil at the end face of the molten metal pouring nozzle 50 to thereby prevent burning and reduce carbide due to the lubricating oil.

That is, the present invention has a structure as recited in the following items [1] to [9].

[1] A continuous casting device in which a molten metal pouring nozzle is arranged between a molten metal receiving portion and a mold, wherein the molten metal pouring nozzle is equipped with a cylindrical main body portion made of a fire-resistant substance and having a molten metal passage, and wherein an annular member having self-lubricating property is arranged on a mold-side end face of the main body portion so as to surround the molten metal passage.

[2] The continuous casting device as recited in the aforementioned Item 1, wherein the annular member is arranged at an area including a start point where gas accumulation starts to occur.

[3] The continuous casting device as recited in the aforementioned Item 1 or 2, wherein the annular member is arranged at a portion facing a molding hole of the mold, at least at an outer side area of a molding hole peripheral side of the portion.

[4] The continuous casting device as recited in any one of the aforementioned Items 1 to 3, wherein an outer diameter of the annular member is smaller than a diameter of the molding hole of the mold, and the main body portion is exposed at an outermost area continued from a molding hole periphery of a portion facing the molding hole of the mold.

[5] The continuous casting device as recited in any one of the aforementioned Items 1 to 4, wherein an inner diameter of the annular member is larger than a diameter of the molten metal passage, and the main body portion is exposed at an inner side area continued from the molten metal passage in a portion facing the molding hole of the mold.

[6] The continuous casting device as recited in the aforementioned Item 5, wherein an extended amount of the annular member from a molding hole periphery of the mold is 2 to 10% of a diameter of the molding hole.

[7] The continuous casting device as recited in any one of the aforementioned Items 1 to 6, wherein the continuous casting device is a horizontal continuous casting device in which a central axis of a molding hole of a die is arranged approximately horizontally.

[8] The continuous casting device as recited in any one of the aforementioned Item 1 to 7, wherein the annular member is made of graphite.

[9] A molten metal pouring nozzle to be arranged between a molten metal receiving portion and a mold of a continuous casting device, wherein the molten metal pouring nozzle is equipped with a cylindrical main body portion made of a fire-resistant substance and having a molten metal passage, and wherein an annular member having self-lubricating property is arranged on a mold-side end face of the main body portion so as to surround the molten metal passage.

Effects of the Invention

In the continuous casting device as recited in the aforementioned Item [1], by arranging the annular member having self-lubricating property on a mold-side end face of the molten metal pouring nozzle, lubricating property is given to the end face. For this reason, even in cases where a thin solidified shell is formed at the vicinity of the periphery of the forming hole of the mold of the mold-side end face of the molten metal pouring nozzle, the molten metal can slide, preventing adhesion to the molten metal pouring nozzle to thereby prevent burning and breakout, which in turn can perform stable casting of an ingot with high casting surface quality for a long period of time. Furthermore, since the lubricating property of the molten metal pouring nozzle is enhanced, the used amount of the lubricating oil can be reduced, reducing the creation amount of carbide due to the lubricating oil, which in turn can reduce the involved amount of carbide.

According to the continuous casting device as recited in the aforementioned Items [2], [3], and [4], the annular member having self-lubricating property is arranged at the minimal portion, and the aforementioned effects can be attained.

According to the continuous casting device as recited in the aforementioned Items [5] and [6], even in cases where the annular member is constituted by a material high in thermal conductivity, cooling of molten metal is not excessively enhanced, and adhesion of the molten metal can be prevented.

In cases where the continuous casting device as recited in the aforementioned Item [7] is a horizontal continuous casting device, since the molten metal and ingot are pressed to the lower surface side by gravity, there is a tendency that the solidification quickly starts at the lower surface side. For this reason, in a horizontal continuous casting device, since the possibility of pulling out the ingot in a state in which a solidified shell is being created increases, the significance of preventing adhesion of the molten metal by applying the present invention to a horizontal continuous casting device to enhance the lubricating property of the mold-side end face of the molten metal pouring nozzle is large.

According to the continuous casting device as recited in the aforementioned Item [8], the aforementioned effects can be attained by using graphite excellent in self-lubricating property as the annular member.

In the molten metal pouring nozzle as recited in the aforementioned Item [9], since the annular member having self-lubricating property is arranged at the mold-side end face, by arranging the nozzle between the molten metal receiving portion and the mold, even in cases where a thin solidified shell is created at the mold-side end face of the molten metal pouring nozzle, the molten metal can slide, preventing adhesion of the molten metal to the end face, which can perform stable casting of an ingot having good casting surface quality for a long period of time.

BRIEF DESCRIPTION OF THE REFERENCE NUMERALS

| | |
|---|---|
| 1: | horizontal continuous casting device (continuous casting device) |
| 10: | molten metal receiving portion |
| 20: | molten metal pouring nozzle |
| 21: | molten metal passage |
| 22: | main body portion |
| 23: | mold-side end face |
| 30, 31: | annular member |
| 40: | mold |
| 41: | molding hole |
| A: | extended amount |
| L1: | inner side area |
| L2: | outer side area |
| L3: | outermost area |

EMBODIMENTS FOR CARRYING OUT THE INVENTION

Figure 1:
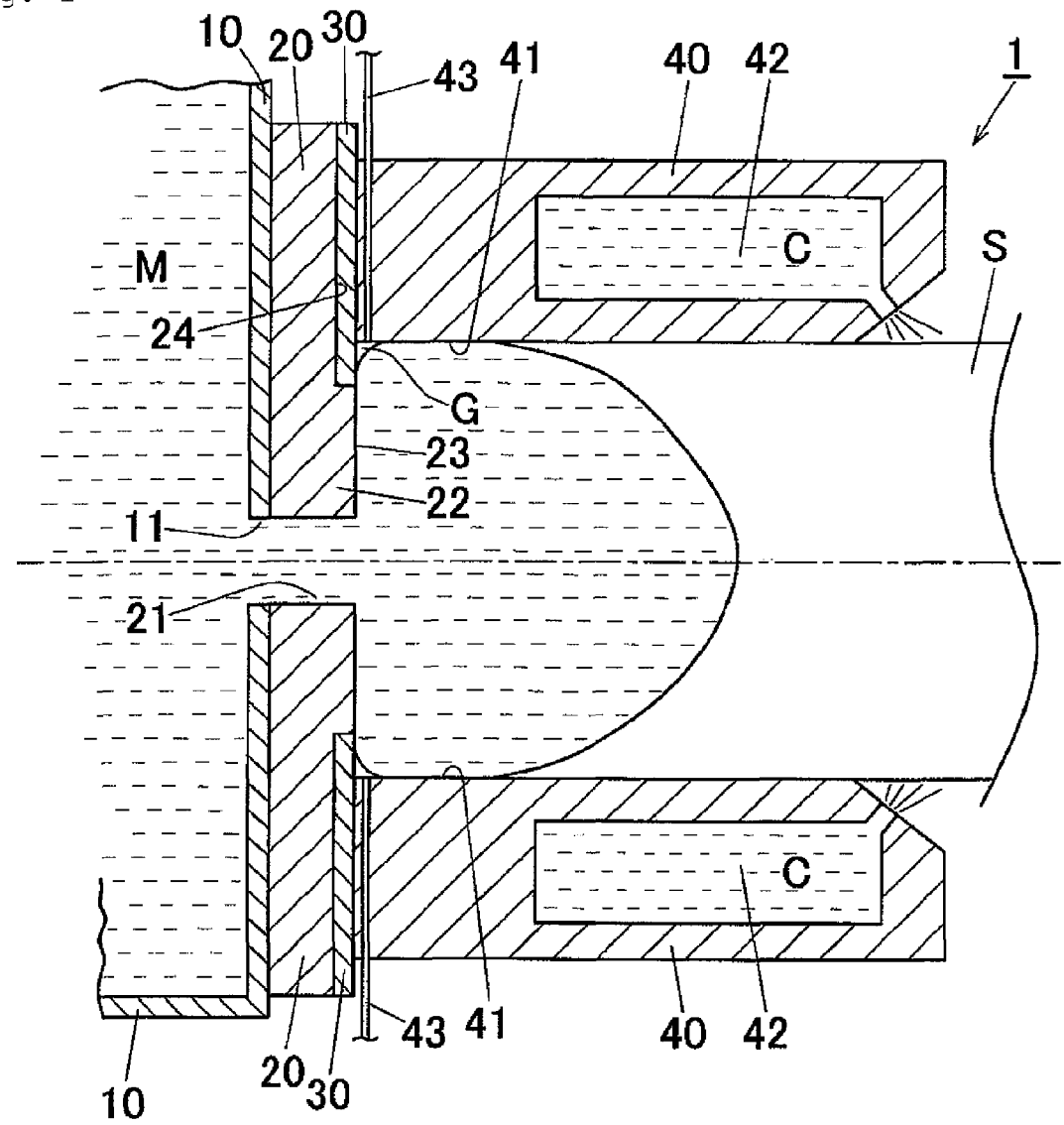
FIG. 1 is a schematic cross-sectional view showing a horizontal continuous casting device according to an embodiment of the present invention.
Figure 2A:
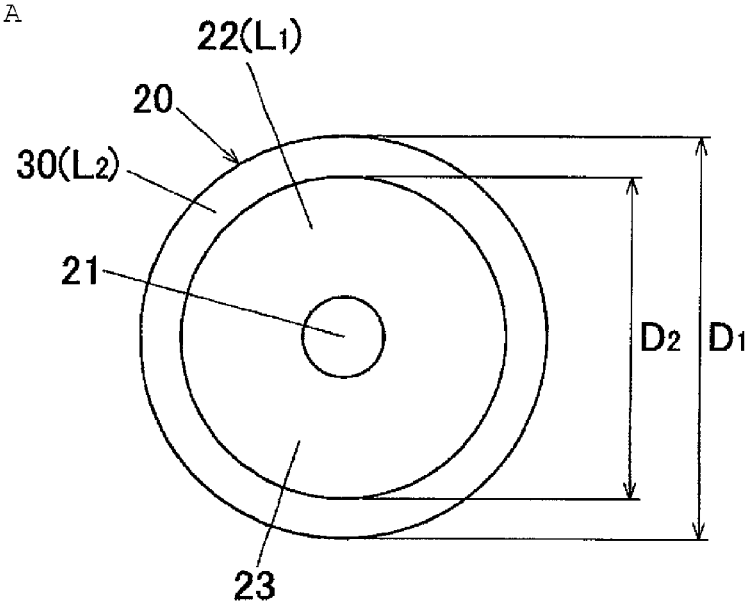
FIG. 2A is a view showing a mold-side end face of a molten metal pouring nozzle as seen from the molding hole of the mold.
Figure 2B:
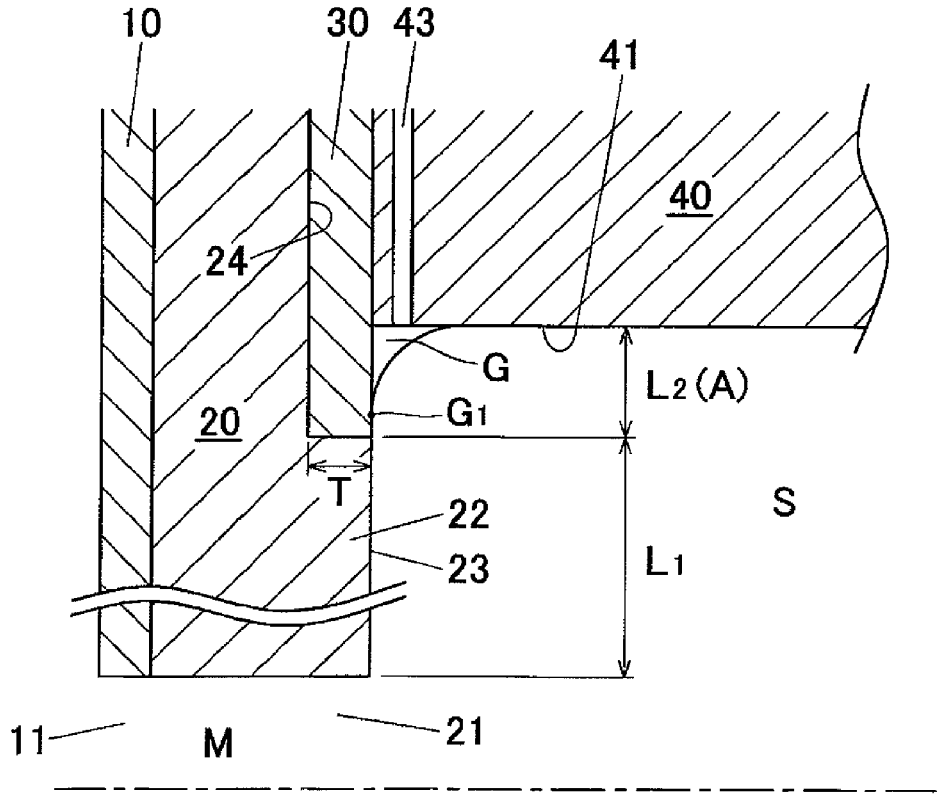
FIG. 2B is a cross-sectional view showing the vicinity of the corner between the mold-side end face of the molten metal pouring nozzle and the molding hole of the mold.

FIGS. 1 to 2B show a horizontal continuous casting device 1 which is an example of a continuous casting device according to the present invention.

In the aforementioned horizontal continuous casting device 1, "10" denotes a molten metal receiving portion having a metal output portion 11 at the side wall, "20" denotes a molten metal pouring nozzle having a molten metal passage 21 round in cross-section, and "40" is a cylindrical mold having a molding hole 41 round in cross-section. In these members 10, 20, and 40, the molten metal output portion 11, the molten metal passage 21 and the molding hole 41 are communicated with each other, and the central axis of the communicated holes are arranged approximately horizontally. The molten metal M in the molten metal receiving portion 10 is introduced into the molding hole 41 of the mold 40 via the molten metal passage 21 of the molten metal pouring nozzle 20 and cooled to be solidified. The solidified ingot S is continuously pulled out from the mold 40 with a pulling device (not illustrated). The pulling rate becomes equal to a casting rate, and the rate can be set to, for example, 300 to 1,500 mm/min.

The mold 40 has a cavity 42 therein and is configured to flow cooling water C supplied from a supplying pipe (not illustrated) through the cavity 42 to cool the mold 40 to thereby perform primary cooling of the ingot S in the molding hole 41 and spray the cooling water C through the opening formed at the outlet side toward the ingot S casted from the outlet to perform secondary cooling of the ingot S. At the inlet side of the molding hole 41, a lubricating oil supplying pipe 43 opened to the molding hole 41 is provided.

The molten metal pouring nozzle 20 has, at its central portion, a molten metal passage 21 and is provided with a cylindrical main body portion 22 made of a porous fire-resistant substance, and an annular member 30 made of graphite higher in self-lubricating property than the fire-resistance material is arranged on the mold-side end face 23 of the main body portion 22.

On the mold-side end face 23 of the main body portion 22, an annular stepped portion 24 concentric with the molten metal passage 21 is formed, and the annular member 30 having the same thickness as the depth of the annular stepped portion 24 is fitted in the annular stepped portion 24. With this, the mold-side end face 23 of the molten metal pouring nozzle 20 forms a continuous single plane surface by these two members, and the fire-resistant substance which is a material of the main body portion 22 is exposed at the inner side area L1 continued from the molten metal passage 21, and the remaining area is covered with graphite which is a material of the annular member 30.

FIG. 2A is a view showing an end face 23 of a molten metal pouring nozzle 20 as seen from the molding hole 41 side of the mold 40. FIG. 2B is a cross-sectional view showing the vicinity of the corner between the molten metal pouring nozzle 20 and the molding hole 41 of the mold 40.

The diameter D1 of the molding hole 41 of the mold 40 is larger than the diameter of the molten metal passage 21 of the molten metal pouring nozzle 20 and the inner diameter D2 of the annular member 30. When the mold-side end face 23 of the molten metal pouring nozzle 20 is viewed from the molding hole 41 of the mold 40, the entire inner side area L1 in which the main body portion 22 is exposed and a part of the annular member 30 can be seen outside the inner side area. In other words, at the portion of the mold-side end face 23 facing the molding hole 41 of the mold 40, the main body portion 22 exists at the circular inner side area L1 continued from the molten metal passage 21 and the annular member 30 exists at the outer side area L2 arranged at the peripheral side of the molding hole 41.

The outer side area L2 in which the annular member 30 exists corresponds to the area in which gas accumulation G is formed, and the extended amount A of the annular member 30 from the periphery of the molding hole 41 is set such that the molten metal M detaches from the molten metal pouring nozzle 20 on the annular member 30 and the starting point G1 where the gas accumulation G starts to form exists on the annular member 30.

The gas accumulation G is formed at the corner between the mold 40 and the molten alloy M by vaporized gas of the lubricating oil or air, or combination thereof, and the shape or size of the gas accumulation G changes depending on the amount of the vaporized lubricating oil or air.

Although the graphite constituting the annular member 30 has high lubricating property itself, the lubricating oil injected to the inlet side of the molding hole 41 of the mold 40 directly adheres, or vaporizes to be adhered, whereby the lubricating property is further enhanced.

In the aforementioned horizontal continuous casting device 1, the molten metal M passed through the molten metal passage 21 of the molten metal pouring nozzle 20 advances while being contacted with the mold-side end face 23 and detaches from the molten metal pouring nozzle 20 on the annular member 30. Even in cases where a thin solidified shell is formed on the surface of the molten metal M at this stage, the molten metal slides on the annular member 30 high in self-lubricating property, which prevents adhesion to the molten metal pouring nozzle 20. Since the annular member 30 exists along the entire periphery surrounding the molten metal passage 21, adhesion of the molten metal can be assuredly prevented even at the lower side of the molten metal (ingot) where adhesion easily occurs because of the structure of the horizontal continuous casting device. Furthermore, since the annular member 30 has high lubricating property itself, high lubricating property can be attained even with less amount of lubricating oil.

Further, although the molten metal M starts slightly to be cooled immediately after the extrusion from the molten metal passage 21 of the molten metal pouring nozzle 20, if the solidified shell is formed too quickly, the molten alloy tends to adhere at the end face 23 of the molten metal pouring nozzle 20. The graphite constituting the annular member 30 is a material high in self-lubricating property and excellent in heat conductivity, and high in heat releasing performance, and therefore if the graphite is arranged up to the inner side area L1 continued from the molten metal passage 21, a solidified shell will be formed quickly, resulting in an increased risk of adhesion. In order to prevent the risk of adhesion, it is preferable that the inner side area L1 continued from the molten metal passage 21 is formed by a fire-resistant substance which is a material of the main body portion 22 and the annular member 30 is arranged only at the outer side area L2 of the peripheral side of the molding hole 41.

From this viewpoint, as shown in FIG. 2A and FIG. 2B, it is preferable that the extended amount A of the annular member 30 from the molding hole 41 is set to 2 to 10% of the diameter D1 of the molding hole 41. If it is less than 2%, there is a possibility that it may not reach the starting point G1 where the gas accumulation. G starts to occur. If it exceeds 10% and extends largely, there is a possibility that cooling of the molten metal M occurs too quickly. The most preferable extended amount A is 5 to 8% of the diameter D1 of the molding hole 41. However, if the annular member 30 is formed by a material low in thermal conductivity and therefore cooling is performed slowly, the extended amount A can exceed the aforementioned range, and that the entire area of the mold-side end face can be covered by the annular member.

The thickness T of the annular member 30 preferable falls within the range of 1 to 10 mm. If the thickness is 1 mm or more, the annular member 30 can be formed easily and inexpensively. If it exceeds 10 mm, the heat releasing amount from the annular member 30 becomes large, resulting in early formation of the solidified shell, which may result in insufficient formation of gas accumulation G. The more preferable thickness is 2 to 6 mm.

Figure 3:
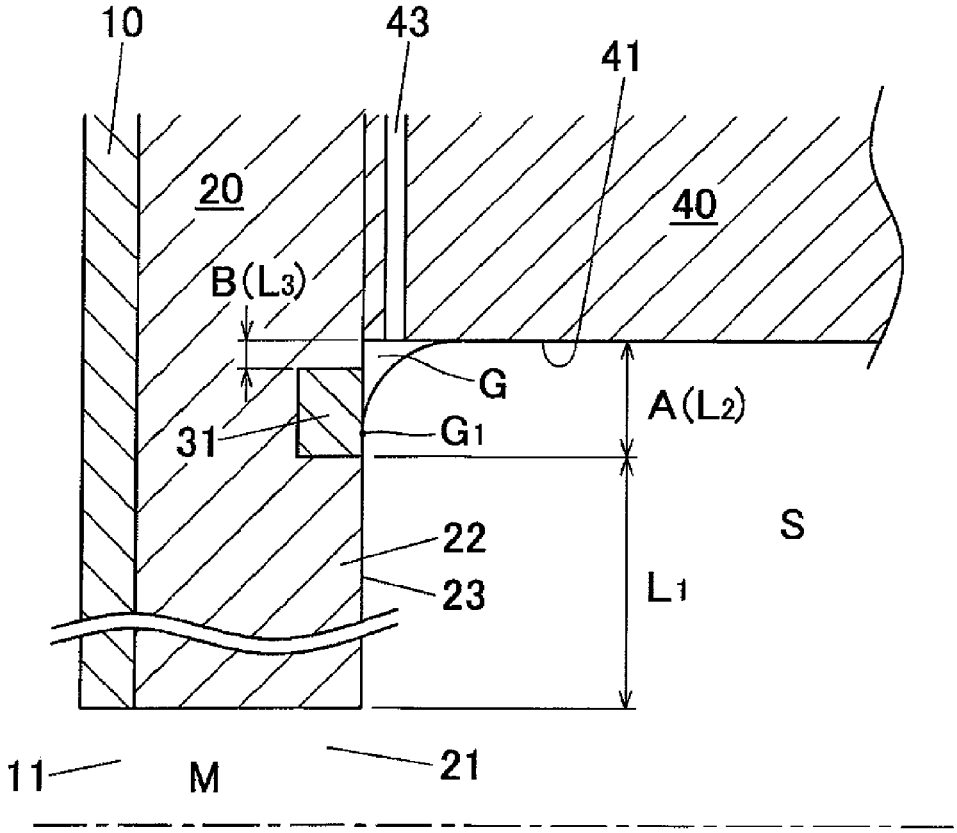
FIG. 3 is a cross-sectional view showing an example of another arrangement of the annular member.

Furthermore, since no lubricating property is required at the portion outer than the point where the molten metal M has detached from the end face 23 of the molten metal pouring nozzle 20, or the portion outer than the starting point G1 where the gas accumulation G starts to occur, the fire-resistance material of the main body portion 22 can be exposed at the end face 23 at the outermost area continued from the periphery of the molding hole 41. As shown in FIG. 3, the present invention includes the case in which the outer diameter of the annular member 31 is smaller than the diameter of the molding hole 41 and the main body portion 22 is exposed at the outermost area L3 continued from the periphery of the molding hole 41. The outermost area L3 is preferably set such that the extended amount B from the periphery of the molding hole 41 falls within 2% or less of the diameter D1 of the molding hole 41 so as to cope with the volume changes of the gas accumulation G.

Even if a member having self-lubricating property exists up to the periphery of the molding hole 41 or the annular member 30 exists up to the corner portion of the mold 40 as shown in FIG. 1, there is no inconvenience to perform casting. It is sufficient that the annular member is arranged at the area including at least the starting point where gas accumulation occurs, and therefore the size and/or the arrangement area of the annular member can be arbitrarily decided based on the time and effort required for manufacturing the main body portion and the time and effort required for assembling with the self-lubricating member. In the molten metal pouring nozzle 20 shown in FIG. 1, the forming of the stepped portion 24 and the assembling with the annular member 30 can be performed easily.

In the present invention, the material of the annular member is not limited to graphite, but can be any material having self-lubricating property. As another materials, C (soft graphite sheet) and BN (boron nitride) can be exemplified. As the soft graphite sheet, a sheet made by Grafoil Corporation can be exemplified. These are materials high in thermal conductivity in the same manner as in graphite, and therefore it is preferable not to be disposed at the inner side area L1 continued from the molten metal passage 21.

The graphite (including soft graphite sheet) and EN exemplified as a material having self-lubricating property have a graphite structure and therefore do not react with molten metal such as molten aluminum. In the material having a self-lubricating property, it is preferable that the contact angle with respect to molten alloy falls within the range of 110 to 180°. It is preferable that the thermal conductivity is 0.15 or more cal/(cm·sec·° C.) [63 W/(m·K)], more preferably 0.15 to 0.8 cal/(cm·sec·° C.) [63 to 336 W/(m·K)]. Table 1 shows examples of material properties of EN and graphite. The contact angles shown in Table 1 are values measured by contacting molten aluminum alloy of 800° C. to a test piece with a surface roughness Ra of 1 μm. The reactivity was evaluated as non-reactive when the molten aluminum alloy adhered to the test piece could have been wiped off after measuring the contact angle.

TABLE 1

| Material | Thermal conductivity Upper: cal/(cm · sec · ° C.) Lower: W/(m · K) | Structure | Contact angle (degree) | Reactivity |
|---|---|---|---|---|
| BN (boron nitride) | 0.18<br>75 | Graphite structure | 150 | None |
| Graphite | 0.25-0.58<br>105-243 | Graphite structure | 121 | None |

Figure 4:
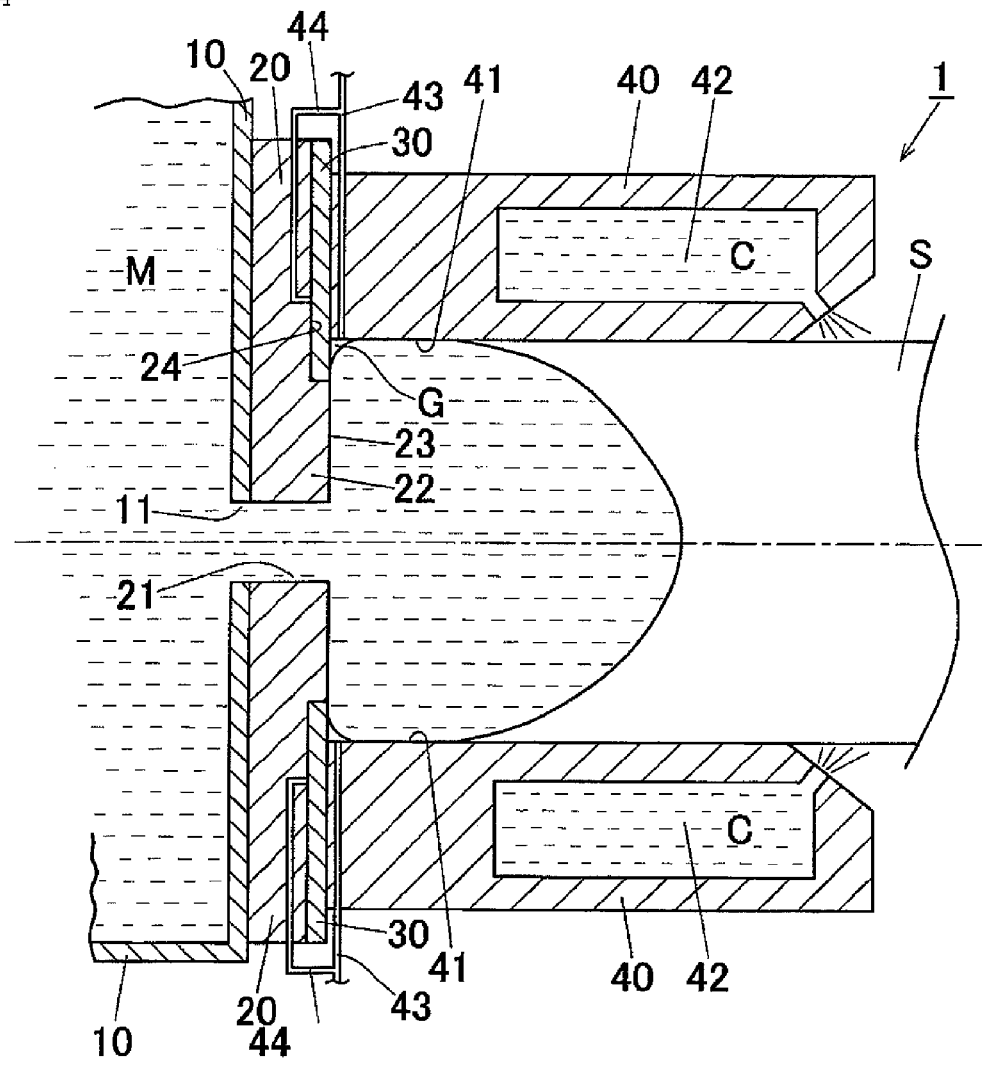
FIG. 4 is a schematic cross-sectional view of a horizontal continuous casting device having another lubricating oil supplying passage.

The supplying passage of the lubricating oil to the annular member 30 can be set arbitrarily, and the lubricating oil supplied to the mold 40 can be utilized as shown in FIG. 1. Furthermore, by forming a slit between the annular member 30 and the mold 40 and supplying lubricating oil through the slit, the lubricating oil can be supplied to both the annular member 30 and the mold 40. Furthermore, as shown in FIG. 4, it can be configured such that a lubricating oil supplying pipe 44 is connected to the annular member 30 to cause oozing of lubricating oil from the graphite. If the supplying pipe is also used as the supplying pipe 43 to the mold 40 as shown in FIG. 1, the supplying device can be simplified. If a slit is formed between the annular member 30 and the mold 40 to supply lubricating oil, the lubricating oil can be supplied to both the mold and the molten metal pouring nozzle, and the supplying device can be further simplified since the supplying pipe can be eliminated. On the other hand, if lubricating oil is supplied to the annular member 30 as shown in FIG. 4, it becomes possible to control supplying of lubricating oil independently from the mold 40, which is advantage in minute control.

Figure 5:
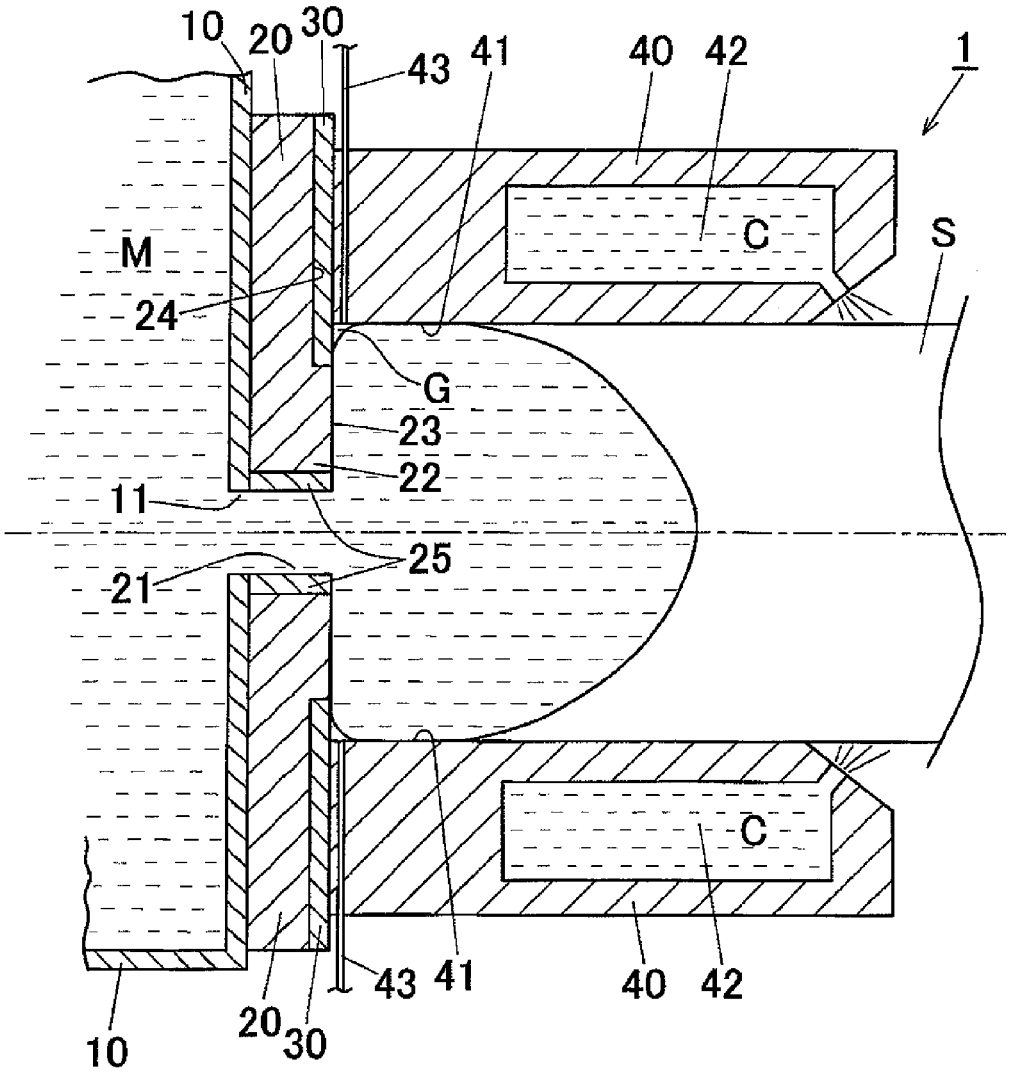
FIG. 5 is a schematic cross-sectional view of another embodiment of a continuous casting device according to the present invention.

Furthermore, as shown in FIG. 5, it is also preferable to arrange a sleeve 25 having a texture more dense than the fire-resistant substance at the molten metal passage 21 of the molten metal pouring nozzle 20. As the fire-resistant substance constituting the main body portion 22, a porous material, such as, e.g., calcium silicate or a mixture of silica and alumina, is used in many cases. If the main body portion 22 is made of a porous fire-resistant substance, vaporized lubricating oil is introduced into the main body portion 22 from the mold-side end face 23 and may be oozed from the molten metal passage 21 via the inner side of the main body portion 22. When the molten alloy M contacts the lubricating oil at the molten metal passage 21, carbide will be created and involved into the surface portion of the molten alloy M in accordance with the flow thereof and solidified, which provides cause of deteriorated ingot quality. Providing the aforementioned sleeve 25 at the molten metal passage 21 prevents oozing of the lubricating oil, which makes it possible to control the creation amount of carbide. As the material of the sleeve 25, since it is required to be fire-resistance and have a texture more dense than the main body portion 22, ceramic, such as, e.g., silicon nitride, can be recommended.

The thickness of the sleeve 25 is not limited, but preferably falls within the range of 0.5 to 3 mm. If it is less than 0.5 mm, sufficient effects cannot be obtained, and strength will be insufficient, resulting in high risk of breakage. On the other hand, if it exceeds 3 mm, heat will be released at the time of starting the casting, which may cause deterioration of fluidity of the molten metal in the flow passage. The preferable thickness of the sleeve 25 is 1 to 2 mm.

Figure 6:
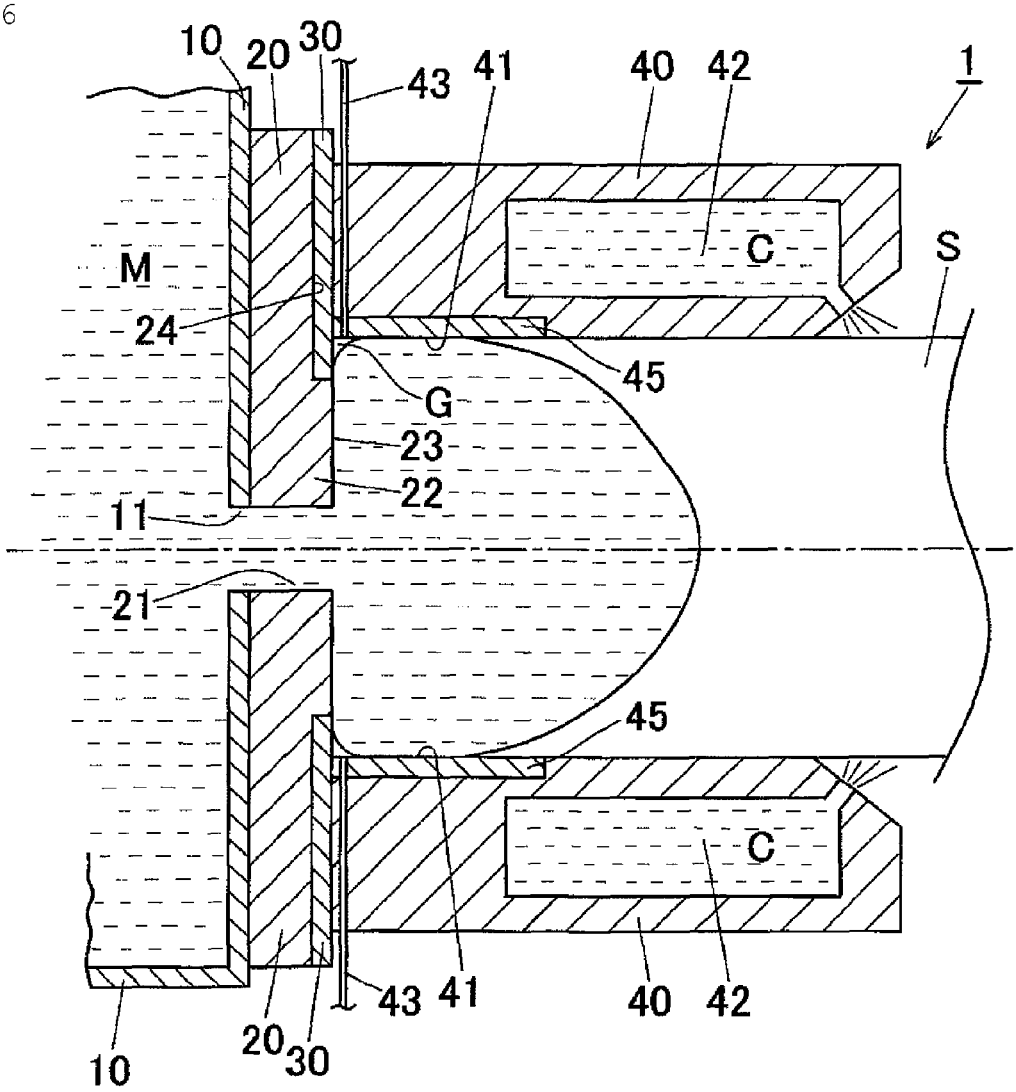
FIG. 6 is a schematic cross-sectional view of still another embodiment of a continuous casting device according to the present invention.

Furthermore, in the continuous casting device of the present invention, it can be arbitrarily to add a means for enhancing lubricating property of the mold. For example, as shown in FIG. 6, a sleeve 45 formed by a material high in self-lubricating property, e.g., graphite, can be provided at the peripheral wall of the molding hole 41 of the mold 40 to enhance the sliding of the ingot.

As explained above, by arranging an annular member having self-lubricating property at the mold-side end face of the molten metal pouring nozzle, even if a thin solidified shell is formed at the end face of the molten metal pouring nozzle, adhesion of the ingot can be prevented. Furthermore, since the annular member has self-lubricating property, the amount of lubricating oil can be decreased. By reducing the used amount of the lubricating oil, the creation amount of the carbide due to the lubricating oil decreases, resulting in less involvement of carbide. The increased creation amount of carbide increases the depth of involvement, causing deterioration of the ingot quality. Therefore, in order to remove the involved carbide, deep removal from the ingot surface will be required. Thus, reducing the involved amount of carbide enables improvement of the material yield ratio. As will be understood from the above, enhancing the lubricating property of the mold side end face 23 of the molten metal pouring nozzle 20 prevents adhesion of the molten metal which starts to be solidified, which in turn can attain stable casting of a high quality ingot for a long period of time.

The continuous casting device of the present invention is not limited to the illustrated horizontal continuous casting device in which the central axis of the molding hole of the mold is arranged approximately horizontally so that the ingot advances generally horizontally, and can be applied to another casting device such as a vertical continuous casting device. However, because of the following reasons, the effects of the present invention are notable in a horizontal continuous casting device.

In the horizontal continuous casting device, it is considered that the molten metal and ingot are pressed to the lower surface side of the mold, creating a solidified shell at the vicinity of the molten metal pouring nozzle of the mold and starting a partial solidification. It is considered that pressing the ingot toward the lower surface side increases cooling thereof, which quickens the solidification start of the lower surface side. When the solidification starts quickens partially, the possibility of creating a solidified shell at the portion in contact with the mold-side end face of the pouring nozzle increases, and the possibility of adhesion to the molten metal pouring nozzle increases when the ingot is pulled out in a state in which the solidified shell is being created. As explained above, in the horizontal continuous casting device, the possibility of creation of a solidified shell at the mold-side end face of the molten metal pouring nozzle is higher than in a vertical continuous casting device, and the risk of adhesion is large. For the reasons mentioned above, the significance of applying the continuous casting device of the present invention in which the lubricating property is enhanced at the mold-side end face of the molten metal pouring nozzle is large in a horizontal continuous casting device.

The continuous casting device of the present invention can be applied to casting of any metal. For example, it can be applied to a continuous casting of aluminum or aluminum alloy. Especially in cases where it is applied to continuous casting of easy-to-adhere metal, remarkable effects can be exerted. As such easy-to-adhere metal, Al alloy containing Mg can be exemplified.

EXAMPLES

In a horizontal continuous casting device, continuous casting tests of aluminum alloy were performed while changing conditions of a molten metal pouring nozzle arranged between a molten metal receiving portion and a mold.

As a test alloy in each example, aluminum alloy consisting of Si: 0.6 mass %, Fe: 0.3 mass %, Cu: 0.3 mass %, Mn: 0.05 mass %, Mg: 1.0 mass %, Cr: 0.2 mass %, Ti: 0.02 mass %, and the balance being Al and impurities was used. The diameter D1 of the molding hole 41 of the mold 40 was 42 mm, and the diameter D2 of the molten metal passage 21 of the molten metal pouring nozzle was 20 mm. The main body portion 22 of the molten metal pouring nozzle 20 was made of porous calcium silicate. The casting temperature and the casting rate were commonly set to 720° C. and 600 mm/min, respectively.

Examples 1 and 2

As shown in FIGS. 1, 2A and 2B, an annular member 30 made of graphite having a thickness T of 3 mm was arranged on the mold-side end face 23 of the main body portion 22 of the molten metal pouring nozzle 20 so that the extended amount A of the annular member 30 from the periphery of the molding hole 41 of the mold 40 became 3 mm or 2.2 mm. The lubricating oil supplying tube 43 was opened in the molding hole 41 of the mold 40 and the lubricating oil to be supplied to the mold 40 was utilized. The lubricating oil was supplied by the amount shown in Table 2.

Examples 3 and 4

As shown in FIG. 5, a sleeve 25 made of silicon nitride having a thickness of 1 mm was mounted on the molten metal passage 21 of the molten metal pouring nozzle 20 to prevent oozing of the vaporized lubricating oil from the molten metal passage 21. The other structure was the same as in Examples 1 and 2.

Examples 5 and 6

As shown in FIG. 6, a sleeve 45 made of graphite was thermally inserted to the peripheral wall of the molding hole 41 of the mold 40 to facilitate the slipping of the ingot S in the mold 40. The other structure was the same as in Examples 1 and 2.

Comparative Example 1

Figure 7:
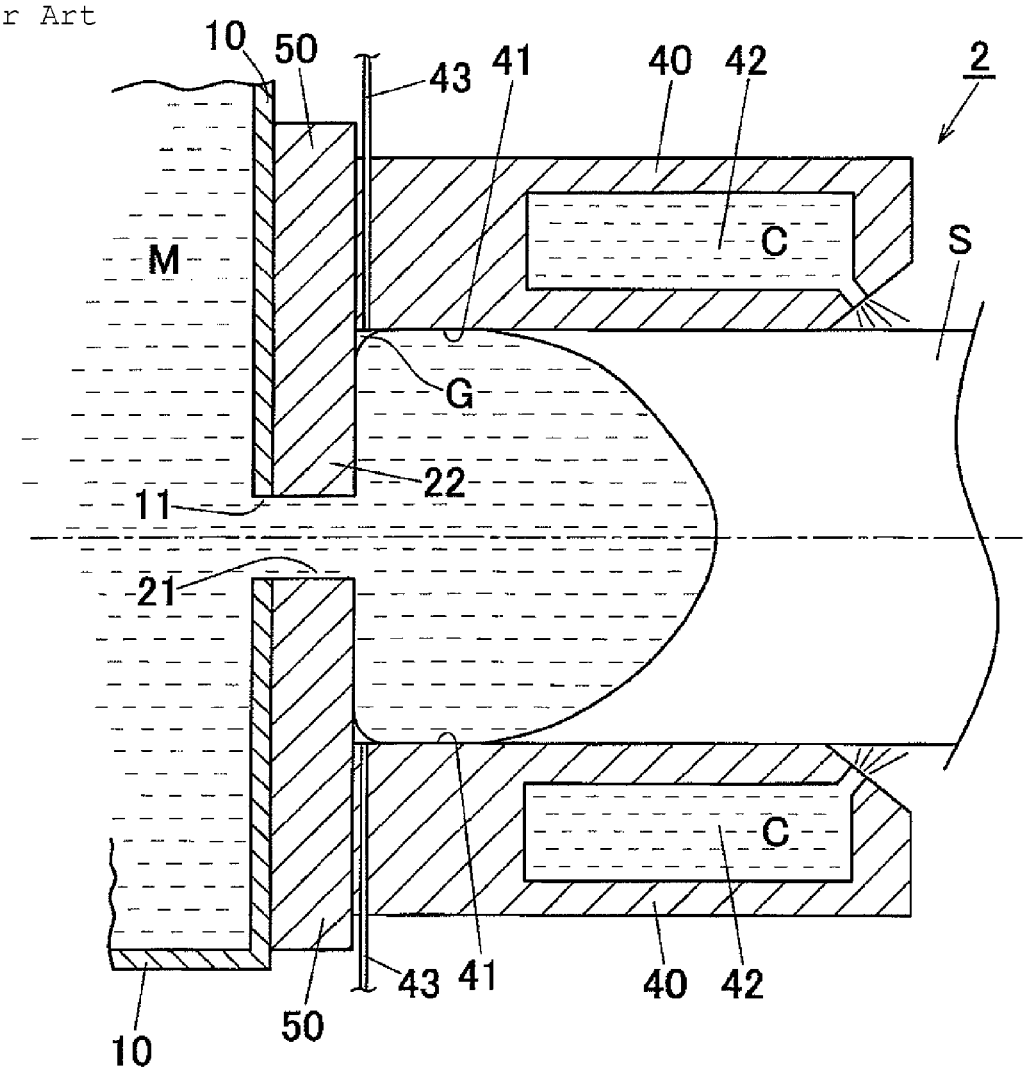
Fig. 7 Prior Art
FIG. 7 is a schematic cross-sectional view showing a conventional horizontal continuous casting device.

In the horizontal continuous casting device 2 shown in FIG. 7, using a molten metal pouring nozzle 50 made of a fire-resistant substance only, an lubricating oil supplying tube 43 was opened in the molding hole 41 of the mold 40 to utilize the lubricating oil to be supplied to the mold 40.

Comparative Example 2

In the horizontal continuous casting device 2 of Comparative Example 1, a sleeve 45 made of graphite was thermally inserted to the peripheral wall of the molding hole 41 of the mold 40 to facilitate the slipping of the ingot S in the mold 40. The other structure was the same as in Comparative Example 1.

In each example, while supplying the lubricating oil by the amount shown in Table 2, continuous operation was performed until breakout of the ingot S occurred.

About the produced ingots S, the casting surface quality was evaluated by observing with naked eyes, and the involved depths of carbide in the surface layer portion were measured. The evaluated results are shown in Table 2.

TABLE 2

| | Header | | | | | | | | |
|---|---|---|---|---|---|---|---|---|---|
| | Annular member | | Sleeve for molten | Mold | | Supplied | | | |
| | Existence or nonexisten | Extended amount (A) | metal pouring passage | Sleeve of molding hole | Device structure | amount of lubricating oil | Continuous operation time | Casting surface | Involved depth of carbide |
| Example 1 | Yes | 3.0 mm | No | No | FIG. 1 | 1.5 g/min | No breakout in 8 hours | Good | 1.0 mm |
| Example 2 | Yes | 2.2 mm | No | No | FIG. 1 | 1.8 g/min | No breakout in 8 hours | Good | 1.3 mm |
| Example 3 | Yes | 3.0 mm | Yes | No | FIG. 5 | 1.0 g/min | No breakout in 8 hours | Good | 0.8 mm |

TABLE 2-continued

| | Header | | | | | | | | |
|---|---|---|---|---|---|---|---|---|---|
| | Annular member | | Sleeve for molten | Mold | | Supplied | | | |
| | Existence or nonexisten | Extended amount (A) | metal pouring passage | Sleeve of molding hole | Device structure | amount of lubricating oil | Continuous operation time | Casting surface | Involved depth of carbide |
| Example 4 | Yes | 2.2 mm | Yes | No | FIG. 5 | 1.3 g/min | No breakout in 8 hours | Good | 1.0 mm |
| Example 5 | Yes | 3.0 mm | No | Yes | FIG. 6 | 1.5 g/min | No breakout in 8 hours | Good | 1.0 mm |
| Example 6 | Yes | 2.2 mm | No | Yes | FIG. 6 | 1.8 g/min | No breakout in 8 hours | Good | 1.3 mm |
| Com. Example 1 | No | | No | No | FIG. 7 | 4 g/min | 5 hours | Tightened surface | 2.0 mm |
| Com. Example 2 | No | | No | Yes | | 4 g/min | 5 hours | Tightened surface | 2.0 mm |

Table 2 reveals that even if the supplied amount of lubricating oil is reduced in each Example, it is possible to perform continuous casting for a long period of time and no tightened surface occurs. Furthermore, by decreasing the supplied amount of the lubricating oil, the creation amount of carbide decreased, and involvement depth in the surface layer portion of the ingot decreased.

This application claims priority to Japanese Patent Application No. 2007-314504 filed on Dec. 5, 2007, the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

According to the continuous casting device of the present invention, the lubricating property of the mold-side end face of the molten metal pouring nozzle can be enhanced and adhesion of the molten metal can be prevented, and therefore the continuous casting device can be utilized especially for a stable casting for a long period of time.

The invention claimed is:

1. A continuous casting device in which a molten metal pouring nozzle is arranged between a molten metal receiving portion and a mold, wherein the molten metal pouring nozzle is equipped with a cylindrical main body portion made of a fire-resistant substance and including a molten metal passage, wherein an annular member having a self-lubricating property is mounted in a stepped portion of the main body, on a mold-side end face of the main body portion, so as to surround the molten metal passage, and wherein an inner diameter of the annular member is larger than a diameter of the molten metal passage, and the main body portion is exposed at an inner side area continuing from the molten metal passage in a portion facing a molding hole of the mold.

2. The continuous casting device as recited in claim 1, wherein the annular member is arranged at an area including a start point where gas accumulation starts to occur.

3. The continuous casting device as recited in claim 1 or 2, wherein the annular member is arranged at a portion facing the molding hole of the mold, at least at an outer side area of a molding hole peripheral side of the portion.

4. The continuous casting device as recited in claim 1 or 2, wherein an outer diameter of the annular member is smaller than a diameter of the molding hole of the mold, and the main body portion is exposed at an outermost area continued from a molding hole periphery of a portion facing the molding hole of the mold.

5. The continuous casting device as recited in claim 1, wherein an extended amount of the annular member from a molding hole periphery of the mold is 2 to 10% of a diameter of the molding hole.

6. The continuous casting device as recited in claim 1 or 2, wherein the continuous casting device is a horizontal continuous casting device in which a central axis of a molding hole of a die is arranged approximately horizontally.

7. The continuous casting device as recited in claim 1 or 2, wherein the annular member is made of graphite.

8. A molten metal pouring nozzle to be arranged between a molten metal receiving portion and a mold of a continuous casting device, wherein the molten metal pouring nozzle is equipped with a cylindrical main body portion made of a fire-resistant substance and including a molten metal passage, wherein an annular member having a self-lubricating property is mounted in a stepped portion of the main body, on a mold-side end face of the main body portion, so as to surround the molten metal passage, and wherein an inner diameter of the annular member is larger than a diameter of the molten metal passage, and the main body portion is exposed at an inner side area continued from the molten metal passage in a portion facing a molding hole of the mold.

* * * * *